United States Patent [19]

Sciarrillo

[11] 4,040,633

[45] Aug. 9, 1977

[54] GOLF SWING TRAINING MACHINE

[76] Inventor: Frank A. Sciarrillo, 9550 Sepulveda Blvd., Sepulveda, Calif. 91343

[21] Appl. No.: 661,658

[22] Filed: Feb. 26, 1976

[51] Int. Cl.[2] ..... A63B 69/36

[52] U.S. Cl. ..... 273/191 A; 273/187 A

[58] Field of Search ..... 273/191 R, 191 A, 191 B, 273/192, 186 R; 35/29 A

[56] References Cited

U.S. PATENT DOCUMENTS

| | | | |
|---|---|---|---|
| 1,854,392 | 4/1932 | Bambrick | 273/191 A X |
| 1,960,787 | 5/1934 | MacStocker | 273/187 A X |
| 3,339,927 | 9/1967 | Nunn | 273/191 A |
| 3,730,531 | 5/1973 | Zega | 273/187 A |

*Primary Examiner*—George J. Marlo

*Attorney, Agent, or Firm*—Christie, Parker & Hale

[57] ABSTRACT

There is described a golf practice device having a golf club guiding member consisting of a single tube wound in the form of a helix having in excess of one and a half turns. The diameter of the helix is somewhat less than the arc of a club head during the golf swing and the guide is supported on the ground or other surface such that the helix lies approximately in the plane defined by the shaft of a golf club during the normal golf swing. One end of the helix terminates adjacent the impact region of the club with the golf ball. The helical guide member extends away from the point of impact in the direction of the back swing. The pitch of the helix increases so that the overlapping turns of the helix are divergent in going from the point of impact to the top of the back swing region of the golf swing. The overlapping turns of the helix are held in fixed spaced relation by a supporting leg in the form of an open loop, the ends of the loop supporting the adjacent overlapping portions of the helical guide. The one end of the helix may be braced from the supporting leg.

7 Claims, 2 Drawing Figures

P2
60
14
16
18
50
30
30
30
48
38
24
26
30
30
36
22
20
44
46
P1
40
28
12
64
62
32
42
34

GOLF SWING TRAINING MACHINE

FIELD OF THE INVENTION

This invention relates to golf practice devices, and more particularly, is concerned with a device for guiding the clubhead through the correct path.

BACKGROUND OF THE INVENTION

The concept of constraining a golf club to move through a predetermined path during the execution of a golf swing by a golfer is well known. By constraining the golf club to move in the optimum path, the golfer is able to "groove" his swing so that, through muscular memory, he will be able to move the club through the proper path when executing a golf shot. Known devices of this type have suffered from one or more of the following defects. They have been heavy and complicated and expensive structures which unduly restricted the golfer's swing. Many such devices do not allow the golfer to actually hit a golf ball with a full power swing. Many require attachments to be made to the golf club and/or the golfer, thus affecting the normal swing weight of the club and unduly restricting normal body movements of the golfer.

SUMMARY OF THE INVENTION

The present invention is directed to an improved golf practice device for training a golfer to confine his back swing and power swing to a proper plane to achieve correct impact with the golf ball. The present invention provides a swing guiding device in which the only constraint imposed on the golf club is to confine the golf club shaft to move in a plane whose attitude in relation to the ground is substantially fixed. The device permits both unrestrained angular and axial movement of the shaft during the swing and even permits an adjustable degree of waggle or looping at the extreme top of the back swing. The device permits hitting a golf ball with full power and a full follow-through. The device is adjustable to accommodate golfers of different height or swinging different clubs. The golfer can use his own golf clubs with a maximum possible natural "feel". No moving parts, latches, or spring-loaded machanisms are involved.

This is accomplished in brief by providing a practice device which comprises a single elongated guide member wound in the form of a helix having a diameter somewhat less then that of the arc traced by the head of a golf club during execution of the golf swing. The helix has in excess of one and a half turns to provide overlapping guide portions through a distance corresponding to the length of the arc of a golf club in moving through the back swing. The helical guide is supported in an inclined position relative to the ground or supporting horizontal surface, the plane corresponding to the normal plane defined by the club shaft when moved through the normal golf swing. The overlapping portions of the helical guide are positioned in the back swing region with one end of the helix terminating adjacent the impact area and the other end of the helix terminating in the region of the top of the back swing. The pitch of the helix varies so that the adjacent turns of the helix are closer together adjacent the impact area and diverge to a greater width at the top of the back swing region.

DESCRIPTION OF THE DRAWINGS

For a better understanding of the invention reference should be made to the accompanying drawings, wherein.

DETAILED DESCRIPTION

Figure 1:
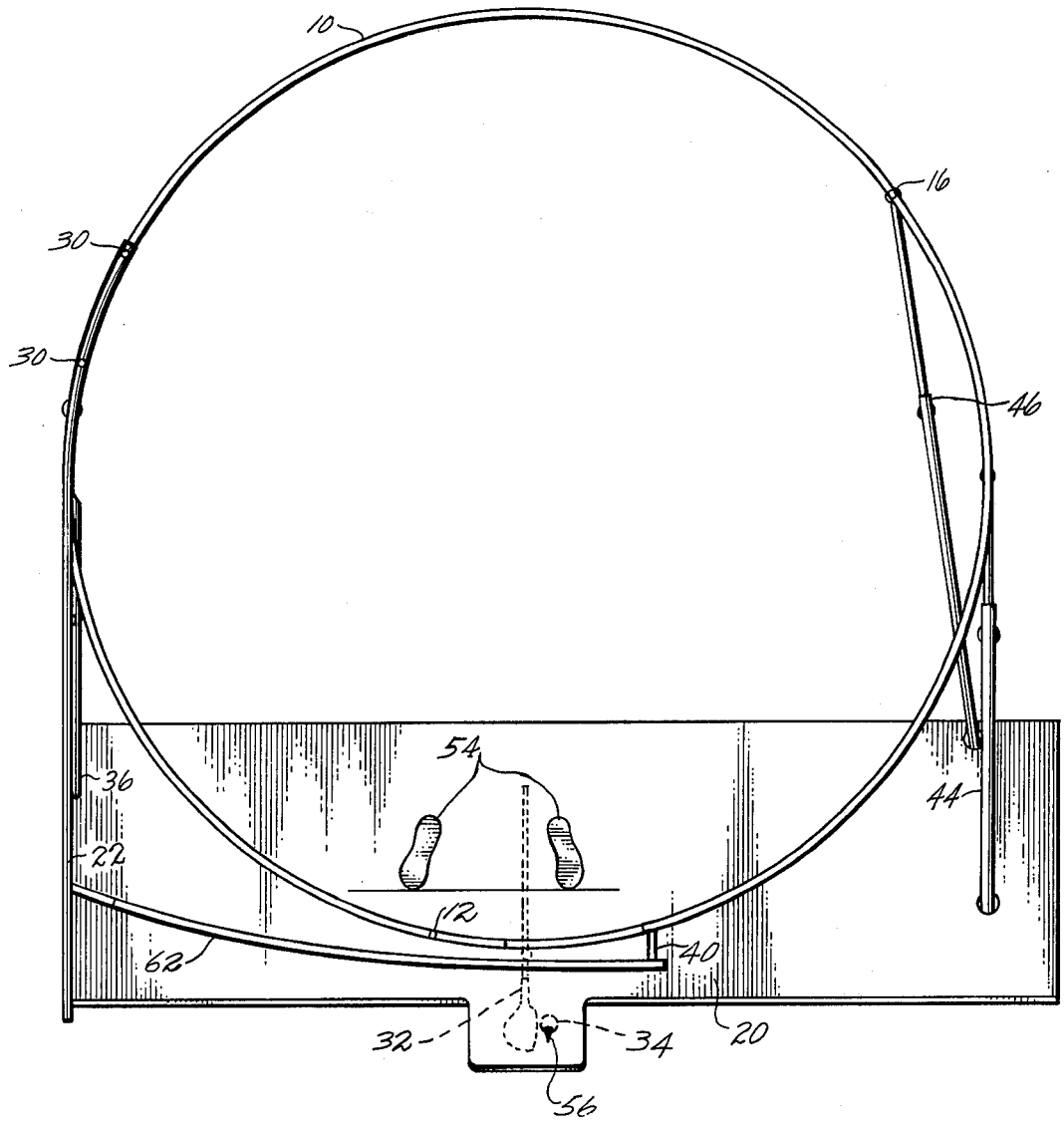
FIG. 1 is a front elevational view of the golf practice device of the present invention.

Referring to the drawings in detail, the golf practice device of the present invention includes a guide member, indicated generally at 10. The guide member is formed of tubular material which may be either light weight metal tubing with a tough outer plastic cover to provide a wear-resistance surface or may be an extruded plastic tubing. The guide member is formed in a circular helix. One end of the guide member terminates at 12. As viewed in FIG. 1, the guide extends from the end 12 in a clockwise direction through a substantially circular path a distance in excess of one and a half turns. The other end of the helical guide terminates in a 90° elbow 14 to which is attached a telescoping pin 16 anchored to the adjacent turn of the guide member. The pin 16 is inserted in the outer end of the tubular elbow 14 and is locked in position by a suitable locking screw 18. This telescoping arrangement allows the spacing between the adjacent turns of the helix in the region at the top of the back swing to be adjusted, as hereinafter described.

Figure 2:
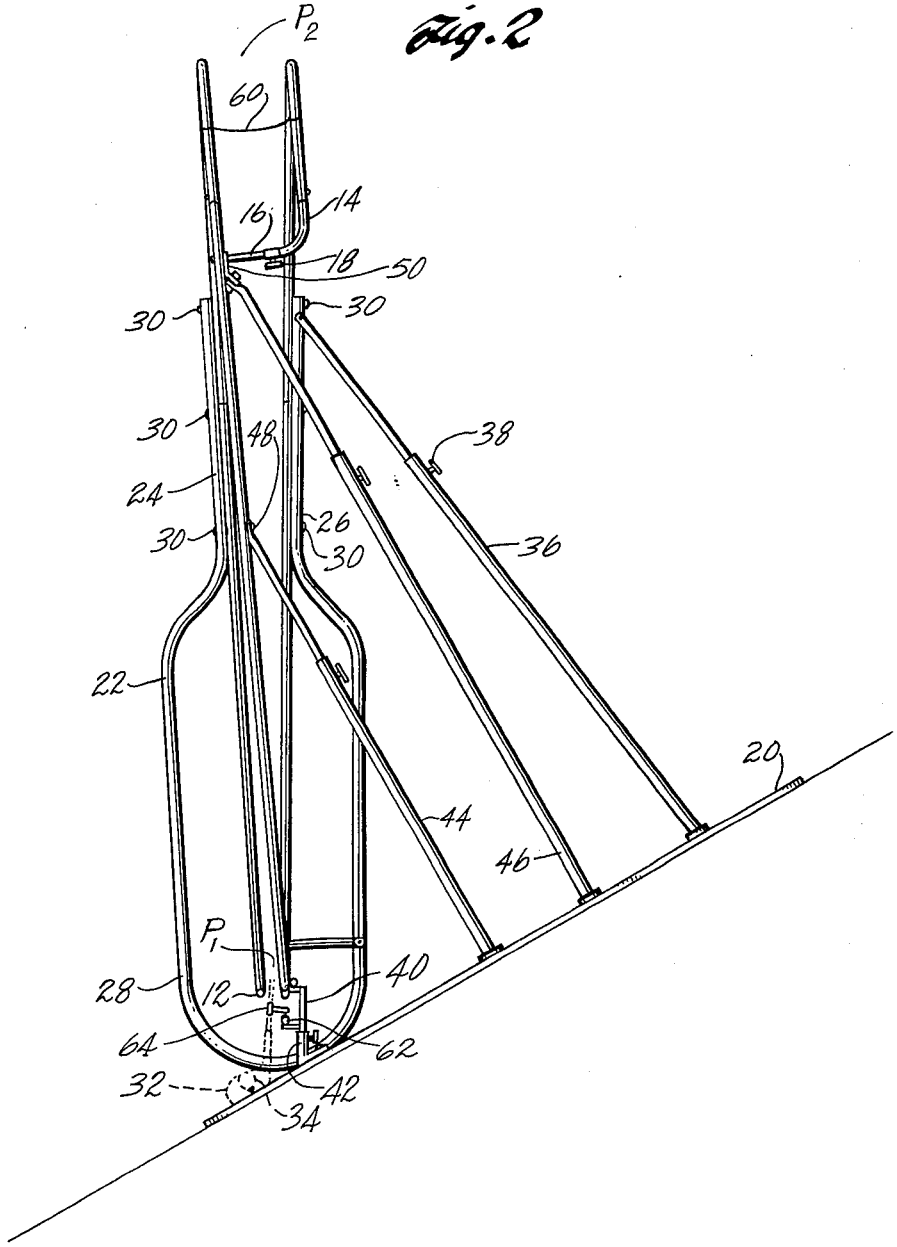
FIG. 2 is a side elevational view of the embodiment of FIG. 1.

The helical guide member is supported from a driving mat or other suitable base 20 which rests on the ground, floor, or other horizontal surface. The supporting structure includes a leg 22 in the form of an open loop. The leg 22, which is also preferably formed of a tubular material so that it is rigid and yet relatively light in weight, includes a pair of spaced parallel end portions 24 and 26 and a lower bight portion 28. The bight portion 28 is adapted to rest on or be secured to the base 20. The end portions 24 and 26 are respectively secured to adjacent turns of the helical guide 10. To this end, the end portions 24 and 26 are formed into an arc of the same radius as the radius of the helical guide member. The helical guide member 10 is bolted or otherwise secured at a plurality of points over the arcuate length of the end portions 24 and 26 of the leg 22, as indicated at 30. It will be noted that the adjacent turns of the helical guide are secured to the end portions 24 and 26 such that the space between the adjacent overlapping turns of the helix at the point of support by the leg 22 forms an open gap, as best seen in FIG. 2. The plane defined by the leg 22 extends in a direction substantially parallel to the axis of the helix, that is, extends in a direction substantially perpendicular to the path of the club, indicated at 32, as it moves through the region of impact with a golf ball, indicated at 34.

A telescopically adjustable tubular leg 36, secured at one end to the end portion 26 of the leg 22, rests on or is secured to the base 20 at a point behind the leg 22. The upper end of the leg 36 is pivotally attached to the top of the end portion 26 of the leg 22. Thus by adjusting the length of the leg 36 as by means of a clamping screw 38, the leg 22 may be angularly adjusted relative to the base 20. Another support member 40 is provided at the center of the guide adjacent the impact area which is secured to the back side of the helical guide 10. The leg 40 is slightly offset to provide ample clearance for the club head in the impact region. The leg 40 rests on or is secured to the base 20 by telescopically engaging a base member 42, which permits the frame to be raised or lowered. Two additional adjustable legs 44 and 46 are provided to support the helical guide in the follow-through region of the golf swing, where the helical turns do not overlap. The leg 44, which is telescopically adjustable in length, has the upper end attached to the helical guide 10 by a screw 48. The leg 46 which also is telescopically adjustable in length, has its upper end anchored to the helical guide by a bracket 50 secured to the guide where the pin 16 is attached.

As thus far described, it will be seen that the present invention provides a helical guide which is supported on a flat surface and can be oriented to restrain the golf club to a predetermined plane during the back swing, power swing, and to limit path during the follow-through. To use the device, the golfer steps into the device, planting his feet at the proper position, as indicated at 54, for addressing a golf ball 34 resting on a tee 56. The position of the golfer's stance of course is adjusted relative to the position of the golf ball, according to the golfer's size and the particular club he is using. The shaft of the golf club 32 in the address position will be substantially in contact with the helical guide 10 with the guide being between the shaft of the club and the golfer's legs.

As the golf club is moved backwards at the start of the backswing, the shaft, as it moves past the end 12 of the guide, enters the gap between adjacent turns of the helix. The pitch of the helix at the start of the backswing is only slightly greater than the diameter of the tubing, as indicated at $P_1$ in FIG. 2. However the pitch of the helix varies so that the space between adjacent turns at the top of the backswing is substantially greater, as indicated at $P_2$ in FIG. 2. As indicated above, the pitch $P_2$ is adjustable by virtue of the telescoping pin 16 and elbow 14. This greater pitch at the top of the backswing permits some wobble or looping of the swing in going from the backswing into the power swing. This is desirable so as not to overly constrain the golfer's swing and to allow for some natural variation in the path of the club head at the upper end of the backswing. A movable strap 60 may be provided which engages the adjacent overlapping portions of the guide in the region at the top of the backswing. This can be moved to different positions to act as a limit on the length of the backswing.

As the club moves down into the power swing, the overlapping turns of the helix guide the club down to the proper path into impact with the ball 34. Just prior to impact, the shaft leaves the constraining gap between the overlapping turns of the helix as it moves beyond the end 12 of the guide 10. During the follow-through, the golf club is only restrained in a direction in which the swing is prevented from being too flat. One advantage of the helical arrangement is that the natural pitch of the helix conforms to the desired "inside out" path of the club as it approaches the point of impact with the golf ball. It will be noted that the open loop construction of the leg 22 allows the club head to move freely through the region of the backswing while at the same time providing rigid support and spacing between the adjacent overlapping turns of the helix.

While the open loop leg 22 is sufficient to support the end 12 of the helical guide in position, additional rigidity and strength may be provided by providing a frame member in the form of a second open-ended loop (not shown). The two ends of such additional loop would be secured respectively to the outer margins of the two overlapping portions of the helical guide 10 at points intermediate the end 12 and the leg 22.

Also an additional guide member 62 may be provided. The guide member 62 is of similar tubular material to the guide member 10. The outer end of the guide member 62 is anchored to the leg 22 while the other end is mounted on the leg 40. The guide member 62 is positioned immediately below and in the same plane as the continuous portion of the helical guide 10 in the impact region. By attaching a guide pin 64 to the club shaft, the club can be constrained against movement in substantially an axial direction of the club shaft. This is particularly helpful in training of blind persons to execute the golf swing and is also helpful to beginners to overcome a tendency to top or hit under the golf ball. Since the added pin 64 on the club changes the swing weight of the club, this feature is not recommended for use after a person becomes more confident in his ability to maintain the club at the right height above the ground through the impact region.

It will be seen that a golf device constructed in the manner described above provides a simple and relatively inexpensive device which can be easily assembled and set up for use at a driving range, in a person's own yard, or whereever the golf swing can be conveniently practiced. While the helical guide 10 is shown as a single continuous length of thubing formed in the shape of a helix, it will be understood that it can be constructed of a plurality of individual arcuate sections of tubing which may be assembled into a single helical guide member.

What is claimed is:

1. A golf practice device comprising a helically shaped guide having at least one and a half turns to provide overlapping portions, means supporting the guide from a horizontal surface with the axis of the helix tilted from the horizontal so as to extend perpendicular to the plane of the normal golf swing, one end of the helical guide terminating adjacent the lowermost part of the helix adjacent the supporting surface and extending from the point of termination in the direction of the backswing to provide spaced overlapping sections of the helical guide in the backswing region of the golf swing.

2. The practice device of claim 1 wherein the pitch of the helix increases in the direction of the backswing so that the overlapping portions of the helical guide diverge from the impact region to the region at the top of the golf backswing.

3. The practice device of claim 1 wherein the guide supporting means includes a supporting leg in the form of an open loop, the ends of the open loop being attached respectively to separate turns of the helical guide in the backswing region.

4. The device of claim 2 wherein the other end of the helical guide terminates in the region of the maximum normal backswing, and means rigidly connecting said other end of the guide to the adjacent overlapping portion of the guide.

5. The device of claim 4 wherein the connecting means is adjustable to vary the spacing between the overlapping turns of the helical guide.

6. The device of claim 3 further including an additional guide member supported at one end by said supporting leg, the additional guide member extending toward and terminating at the impact region and being positioned radially outwardly of and substantially parallel to the helical guide.

7. A golf practice device of claim 1 wherein the helical guide member is of substantially constant radius throughout the length thereof.

* * * * *

UNITED STATES PATENT AND TRADEMARK OFFICE

CERTIFICATE OF CORRECTION

PATENT NO. : 4,040,633

DATED : August 9, 1977

INVENTOR(S) : Frank A. Sciarrillo

It is certified that error appears in the above-identified patent and that said Letters Patent are hereby corrected as shown below:

Column 4, line 26, "thubing" should read -- tubing --;
line 36, before "normal" change "the" to -- a --.

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*